US008744318B2

(12) United States Patent
Kubo et al.

(10) Patent No.: US 8,744,318 B2
(45) Date of Patent: Jun. 3, 2014

(54) DEVELOPING DEVICE AND IMAGE FORMING APPARATUS INCLUDING THE SAME

(75) Inventors: Norio Kubo, Osaka (JP); Yukihiro Mori, Osaka (JP); Asami Sasaki, Osaka (JP)

(73) Assignee: Kyocera Document Solutions, Inc., Osaka (JP)

( * ) Notice: Subject to any disclaimer, the term of this patent is extended or adjusted under 35 U.S.C. 154(b) by 313 days.

(21) Appl. No.: 13/035,027

(22) Filed: Feb. 25, 2011

(65) Prior Publication Data

US 2011/0222912 A1 Sep. 15, 2011

(30) Foreign Application Priority Data

Mar. 15, 2010 (JP) ..... 2010-057363
Mar. 15, 2010 (JP) ..... 2010-057366

(51) Int. Cl.
*G03G 15/08* (2006.01)

(52) U.S. Cl.
CPC .... *G03G 15/0832* (2013.01); *G03G 2215/0827* (2013.01); *G03G 2215/0802* (2013.01)
USPC ..... 399/254

(58) Field of Classification Search
USPC ..... 399/119, 252, 254, 258
See application file for complete search history.

(56) References Cited

U.S. PATENT DOCUMENTS 5,659,859 A * 8/1997 Kikuta et al. ..... 399/256
2007/0025776 A1* 2/2007 Suzuki ..... 399/272
2007/0274741 A1 11/2007 Shiraishi et al.
2008/0038021 A1* 2/2008 Tsuda et al. ..... 399/254
2008/0085137 A1* 4/2008 Suzuki ..... 399/254
2008/0240792 A1* 10/2008 Kita et al. ..... 399/264
2009/0041508 A1 2/2009 Oshikawa et al.
2009/0092419 A1* 4/2009 Iwata et al. ..... 399/254

FOREIGN PATENT DOCUMENTS

| | | |
|---|---|---|
| JP | 4-204877 | 7/1992 |
| JP | 2002-287485 | 10/2002 |
| JP | 2003-263025 | 9/2003 |
| JP | 2003-302835 | 10/2003 |
| JP | 2004-77587 | 3/2004 |
| JP | 2007-147807 | 6/2007 |
| JP | 2007-316130 | 12/2007 |
| JP | 2008-256917 | 10/2008 |
| JP | 2009-8826 | 1/2009 |
| JP | 2009-58939 | 3/2009 |
| JP | 2010-38939 | 2/2010 |

* cited by examiner

*Primary Examiner* — David Gray
*Assistant Examiner* — Thomas Giampaolo, II
(74) *Attorney, Agent, or Firm* — Smith, Gambrell & Russell LLP.

(57) ABSTRACT

Provided is a developing device including: a developing container partitioned into a stirring-transport chamber, a supplying-transport chamber, and a collecting-transport chamber that are arranged substantially in parallel with one another, for storing a two-component developer; a developer carrying member for carrying the developer on a surface thereof; a supplying-transport member located within the supplying-transport chamber; a stirring-transport member located within the stirring-transport chamber; a collecting-transport member located within the collecting-transport chamber, for stirring and transporting the developer in the same direction as the supplying-transport member and at the different speed from the supplying-transport member; a first developer passage for passing the developer from the stirring-transport chamber to the supplying-transport chamber; a second developer passage for passing the developer from the supplying-transport chamber to the stirring-transport chamber; and a communication portion for passing the developer from the collecting-transport chamber to the supplying-transport chamber.

12 Claims, 11 Drawing Sheets

DEVELOPING DEVICE AND IMAGE FORMING APPARATUS INCLUDING THE SAME

This application is based upon and claims the benefit of priority from the corresponding Japanese Patent Application No. 2010-57363 filed on Mar. 15, 2010 and Japanese Patent Application No. 2010-57366 filed on Mar. 15, 2010, the entire contents of which are incorporated herein by reference.

BACKGROUND OF THE INVENTION

1. Field of the Invention

The present invention relates to a developing device mounted to an image forming apparatus such as a copier, a facsimile machine, or a printer and an image forming apparatus including the same, and more particularly, to a developing device which uses a two-component developer made of a magnetic carrier and toner.

2. Description of Related Art

Up to now, as development methods using dry toner which are employed in an image forming apparatus using an electrophotographic process, there are known: a one-component development method which does not use a carrier; and a two-component development method in which a two-component developer for charging non-magnetic toner by using a magnetic carrier is used to develop an electrostatic latent image on an image bearing member (photosensitive member) by a magnetic brush made of toner and a carrier and formed on a developing roller.

The one-component development method is suitable for achieving higher image quality because the electrostatic latent image on the image bearing member is not disturbed by the magnetic brush. However, on the other hand, the toner is charged by a charging roller with a layer thickness on the developing roller being regulated by an elastic regulating blade, and hence an additive to the toner adheres to the charging roller and lowers a charging ability thereof, which makes it difficult to maintain a toner charge amount with stability. Further, the toner sometimes adheres to the regulating blade, resulting in non-uniform layer formation, which causes an image defect.

Further, in a case of color printing for performing color superimposition, because transparency is required for color toner, the color toner needs to be non-magnetic toner. Therefore, a full-color image forming apparatus often adopts the two-component development method of charging and transporting toner by using a carrier.

Incidentally, a developing device generally used in the two-component development method is of a two-axis transport type and includes: a developer supplying/collecting portion in which a stirring-transport screw for supplying the developer to the developing roller and transporting the developer collected from the developing roller is located; and a stirring-transport portion for replenishing the developer transported from the developer supplying/collecting portion with the toner and stirring and transporting the replenished developer.

However, in the above-mentioned two-axis transport type, the developer that has been used for development of the electrostatic latent image on the photosensitive member and has a low ratio (T/C) of the toner to the carrier is collected by the developer supplying/collecting portion and immediately carried onto the developing roller again. This raises a problem that a stable image density cannot be obtained.

In particular, in a case where an image having a high density in part such as a patch image is printed, it is likely to cause a phenomenon called development hysteresis in which a part exhibiting a low toner density occurs in the developer and the previous image appears as an after image (ghost).

As a countermeasure against this, for example, there is known a developing device of a three-axis transport type including: a developer supplying-transport portion for supplying the developer to a developer carrying member (developing roller); a developer collecting-transport portion for transporting the developer collected from the developer carrying member; and a developer stirring-transport portion for replenishing the developer transported from the developer collecting-transport portion with the toner and stirring and transporting the replenished developer, which are separately provided.

According to the above-mentioned method, all the developer with the toner density (T/C) lowered after development is collected by the developer collecting-transport portion and is not immediately used for development, which allows a stable image density to be obtained.

However, in the above-mentioned method, the developer with a low toner density, which has been collected from a surface of the developer carrying member and has been transported through within the developer collecting-transport portion, is merged into the developer within the developer supplying-transport portion at an end portion of the developer supplying-transport portion. Hence, in particular, a high-speed machine exhibiting a high speed of transporting a developer is liable to have the insufficient stirring therein, which causes malfunctions that the toner density (T/C) within the developer is partially lowered and that lowered flowability inhibits the developer from being passed to the developer supplying-transport portion.

Further, as nearing a downstream side of the developer carrying member in the above-mentioned structure, a developer amount within the developer supplying-transport portion decreases, and the developer decreases in volume. Hence, an ability to scoop up the developer may become insufficient in a downstream side portion of the developer carrying member, thereby lowering the image density partially.

In addition, in a case where a toner density sensor and a developer discharge portion are located in the vicinity of a downstream side of the confluence at which the developer is merged, there is a fear that there may occur erroneous detection of the toner density or excessive discharging of the developer due to irregularity caused in the volume of the developer.

SUMMARY OF THE INVENTION

An object of the present invention is to provide a developing device of a three-axis transport type which can effectively suppress unevenness in toner density and a decrease in image density due to insufficient stirring of a two-component developer or an off-balance of the developer, and an image forming apparatus including the same.

A developing device according to one aspect of the present invention includes: a developing container partitioned into a stirring-transport chamber, a supplying-transport chamber, and a collecting-transport chamber that are arranged substantially in parallel with one another, for storing a two-component developer including a carrier and toner; a developer carrying member supported rotatably by the developing container, for carrying the developer on a surface thereof; a supplying-transport member located within the supplying-transport chamber, for stirring and transporting the developer along an axial direction of the developer carrying member and supplying the developer to the developer carrying member; a stirring-transport member located within the stirring-transport chamber, for stirring and transporting the developer in a reverse direction to the supplying-transport member; a collecting-transport member located within the collecting-transport chamber, for stirring and transporting the developer collected from the developer carrying member in the same direction as the supplying-transport member; a first developer passage for passing the developer from the stirring-transport chamber to the supplying-transport chamber; a second developer passage for passing the developer from the supplying-transport chamber to the stirring-transport chamber; and a communication portion for passing the developer from the collecting-transport chamber to the supplying-transport chamber, and in the developing device, a developer transporting speed of the collecting-transport member differs from a developer transporting speed of the supplying-transport member.

Note that, in this specification, the wording "arranged substantially in parallel" represents not only a case where the stirring-transport chamber, the supplying-transport chamber, and the collecting-transport chamber are parallel with one another but also a case of having a predetermined angle thereamong in a horizontal direction or a vertical direction.

Further features and advantages of the present invention will become apparent from the description of embodiments given below.

DETAILED DESCRIPTION OF PREFERRED EMBODIMENTS

Figure 1:
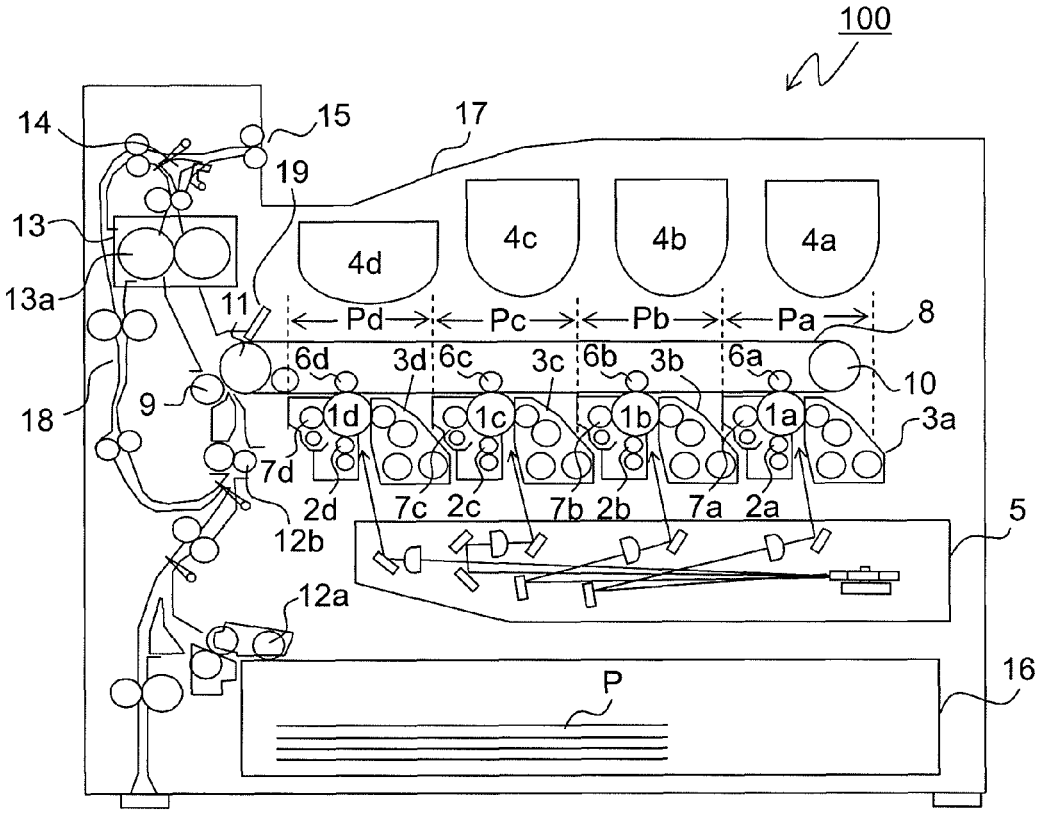
FIG. 1 is a schematic view illustrating overall structure of an image forming apparatus according to the present invention.

Hereinafter, embodiments of the present invention are described with reference to the accompanying drawings. FIG. 1 is a sectional schematic view of an image forming apparatus to which a developing device according to the present invention is mounted, illustrating here a tandem color image forming apparatus. Four image forming portions Pa, Pb, Pc, and Pd are disposed in order from an upstream side in a transporting direction (right side in FIG. 1) in a color printer 100 main unit. Those image forming portions Pa to Pd are provided corresponding to images in different four colors (cyan, magenta, yellow, and black), and respectively form the images in cyan, magenta, yellow, and black successively by respective steps of charging, exposure, development, and transfer.

Photosensitive drums 1*a*, 1*b*, 1*c*, and 1*d* on which visual images (toner images) in the respective colors are formed are disposed in the image forming portions Pa to Pd, respectively. In addition, an intermediate transfer belt 8 caused to rotate clockwise in FIG. 1 by drive means (not shown) is provided adjacent to the respective image forming portions Pa to Pd. The toner images formed on those photosensitive drums 1*a* to 1*d* are sequentially primarily transferred onto an intermediate transfer belt 8 moving in abutment with the respective photosensitive drums 1*a* to 1*d* so as to be superimposed one on another, and then secondarily transferred onto a transfer paper sheet P being an example of a recording medium by action of a secondary transfer roller 9. In addition, the toner images are fixed to the transfer paper sheet P at a fixing portion 13, and are then discharged from the color printer 100 main unit. An image forming process is executed on the respective photosensitive drums 1*a* to 1*d* while the photosensitive drums 1*a* to 1*d* are caused to rotate counterclockwise in FIG. 1.

The transfer paper sheet P onto which the toner images are transferred is received within a sheet cassette 16 in a lower portion of the image forming apparatus, and conveyed via a sheet feeding roller 12*a* and a registration roller pair 12*b* to a nip portion formed between the secondary transfer roller 9 and a drive roller 11 of the intermediate transfer belt 8 described later. A sheet made of a dielectric resin is used for the intermediate transfer belt 8, and a (seamless) belt having no seam is mainly used. Further, a blade-like belt cleaner 19 for removing the toner and the like remaining on a surface of the intermediate transfer belt 8 is located on a downstream side of the secondary transfer roller 9.

Next described are the image forming portions Pa to Pd. Provided around and below the photosensitive drums 1*a* to 1*d* disposed so as to be free to rotate are: chargers 2*a*, 2*b*, 2*c*, and 2*d* for charging the photosensitive drums 1*a* to 1*d*, respectively; an exposure device 5 for performing exposure based on image data with respect to the respective photosensitive drums 1*a* to 1*d* to form an electrostatic latent image; developing units 3*a*, 3*b*, 3*c*, and 3*d* for developing electrostatic latent images, which are formed on the photosensitive drums 1*a* to 1*d*, respectively, to form toner images; and cleaning portions 7*a*, 7*b*, 7*c*, and 7*d* for removing developers (toner) and the like remaining on the photosensitive drums 1*a* to 1*d*, respectively.

When image data is input from a host unit such as a personal computer, the chargers 2*a* to 2*d* first charge surfaces of the photosensitive drums 1*a* to 1*d* uniformly, and then the exposure device 5 applies light to surfaces of the photosensitive drums 1*a* to 1*d* correspondingly to the image data to form electrostatic latent images corresponding to the image data on the respective photosensitive drums 1*a* to 1*d*. The developing devices 3*a* to 3*d* are filled with predetermined amounts of two-component developers containing the respective colors of toner, that is, cyan, magenta, yellow, and black, respectively. Note that, the respective developing devices 3*a* to 3*d* are replenished with toner from respective toner containers 4*a* to 4*d* in a case where the proportion of toner within the two-component developers filling the respective developing devices 3*a* to 3*d* falls below a preset value because of formation of the toner image described later. The toner within the developer is supplied onto the photosensitive drums 1*a* to 1*d* by the developing devices 3*a* to 3*d*, and electrostatically adheres thereto. Thus formed are the toner images corresponding to the electrostatic latent images formed by the exposure performed by the exposure device 5.

Then, by applying a predetermined transfer voltage to primary transfer rollers 6*a* to 6*d* located so as to be brought into press contact with the respective photosensitive drums 1*a* to 1*d* across the intermediate transfer belt 8, the toner images in yellow, cyan, magenta, and black on the photosensitive drums 1*a* to 1*d*, respectively, are primarily transferred onto the intermediate transfer belt 8. The toner images in four colors are formed to have a predetermined positional relationship that is previously defined for forming a predetermined full-color image. After that, in preparation for the formation of new electrostatic latent images to be subsequently performed, the toner and the like remaining on the surfaces of the photosensitive drums 1*a* to 1*d* after the primary transfer are removed by the cleaning portions 7*a* to 7*d*, respectively.

The intermediate transfer belt 8 is stretched around a conveyance roller 10 on an upstream side thereof and the drive roller 11 on a downstream side thereof. When the intermediate transfer belt 8 starts to rotate clockwise in FIG. 1 in accordance with the rotation of the drive roller 11 caused by a drive motor (not shown), the transfer paper sheet P is conveyed from the registration roller pair 12*b* at a predetermined timing to a nip portion (secondary transfer nip portion) between the drive roller 11 and the secondary transfer roller 9 provided adjacent thereto, and a full-color toner image on the intermediate transfer belt 8 is transferred onto the transfer paper sheet P from the intermediate transfer belt 8. Hereinafter, the full-color toner image is abbreviated as "toner image". The transfer paper sheet P onto which the toner image has been transferred is conveyed to the fixing portion 13.

The transfer paper sheet P conveyed to the fixing portion 13 is heated and pressurized by a fixing roller pair 13*a*, and the toner images are fixed to a surface of the transfer paper sheet P to form a predetermined full-color image on the transfer paper sheet P. The transfer paper sheet P on which the full-color image has been formed is directed toward one of a plurality of conveying directions branched from a branch portion 14. In a case where an image is formed on only one surface of the transfer paper sheet P, the transfer paper sheet P is delivered to a delivery tray 17 by delivery rollers 15 as it is.

On the other hand, in a case where an image is formed on both surfaces of the transfer paper sheet P, the transfer paper sheet P that has passed through the fixing portion 13 is temporarily conveyed toward the delivery rollers 15. Then, after a trailing end of the transfer paper sheet P passes through the branch portion 14, delivery rollers 15 are caused to rotate reversely, and a conveying direction of the branch portion 14 is switched over. Accordingly, the transfer paper sheet P has the trailing end directed toward a sheet conveyance path 18, and is again conveyed to the secondary transfer nip portion under a state in which an image surface is reversed. Then, the next image formed on the intermediate transfer belt 8 is transferred onto a surface of the transfer paper sheet P on which no image is formed by the secondary transfer roller 9, is conveyed to the fixing portion 13, has the toner images fixed thereto, and is delivered to the delivery tray 17.

Figure 2:
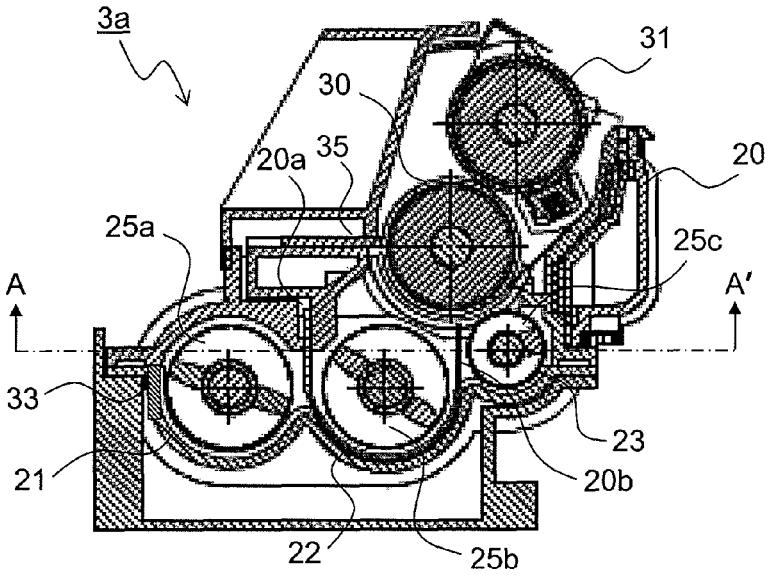
FIG. 2 is a sectional side view illustrating structure of a developing device according to a first embodiment of the present invention.
Figure 3:
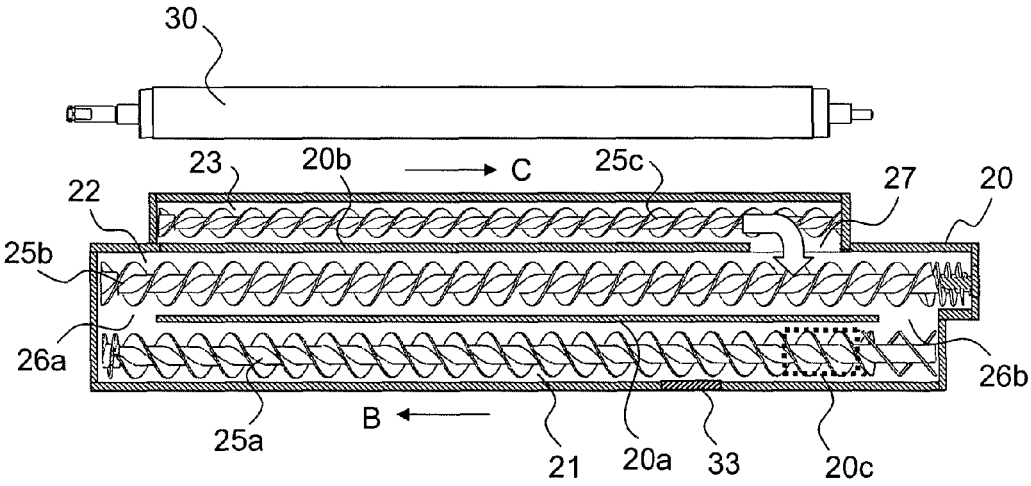
FIG. 3 is a sectional plan view illustrating structure of the developing device according to the first embodiment.

FIG. 2 is a sectional side view of a developing device according to a first embodiment of the present invention, and FIG. 3 is a sectional plan view (sectional view from the arrows AA' of FIG. 2) of the developing device according to the first embodiment. Note that, FIG. 2 indicates a state viewed from a back surface side of FIG. 1, the respective members within the developing device are arranged so as to be horizontally reverse to FIG. 1. Further, the description here is directed to the developing device 3*a* located in the image forming portion Pa of FIG. 1, but the developing devices 3*b* to 3*d* located in the image forming portions Pb to Pd, respectively, basically have the same structure as the developing device 3*a*, and hence description thereof is omitted.

As illustrated in FIG. 2 and FIG. 3, the developing device 3*a* includes a developing container 20 for storing a two-component developer (hereinafter, referred to simply as "developer"), and the developing container 20 is partitioned by partition walls 20*a* and 20*b* into a stirring-transport chamber 21, a supplying-transport chamber 22, and a collecting-transport chamber 23. Rotatably disposed in the stirring-transport chamber 21 and the supplying-transport chamber 22 are a stirring-transport screw 25*a* and a supplying-transport screw 25*b*, respectively, for mixing toner (positively charged toner) supplied from the toner container 4*a* (see FIG. 1) with a carrier, stirring the mixture, and causing the toner to be charged. Further, a collecting-transport screw 25*c* for transporting the developer scraped off from a magnetic roller 30 (described later) serving as a developer carrying member is rotatably disposed the collecting-transport chamber 23.

Then, the developer is transported in axial directions (directions indicated by the arrows B and C of FIG. 3) by the stirring-transport screw 25*a* and the supplying-transport screw 25*b* while being stirred thereby, and is caused to circulate between the stirring-transport chamber 21 and the supplying-transport chamber 22 via a first developer passage 26*a* and a second developer passage 26*b* that are formed in both end portions of the partition wall 20*a*. Further, the developer scraped off from the magnetic roller 30 (described later) is transported in the axial direction (direction indicated by the arrow C) by the collecting-transport screw 25*c*, and is merged into the developer within the supplying-transport chamber 22 from a communication portion 27 formed at one end of the partition wall 20*b*. That is, the stirring-transport chamber 21, the supplying-transport chamber 22, the collecting-transport chamber 23, the first developer passage 26*a*, the second developer passage 26*b*, and the communication portion 27 form a circulating path for the developer within the developing container 20.

The developing container 20 extends obliquely upward to the right in FIG. 2. In the developing container 20, the magnetic roller 30 is located above the supplying-transport screw 25*b*, and a developing roller 31 is opposedly located obliquely upward to the right of the magnetic roller 30. Further, the developing roller 31 is opposed to the photosensitive drum 1*a* (see FIG. 1) on an opening side (right side of FIG. 2) of the developing container 20. With regard to rotational directions about the respective rotary shafts, the magnetic roller 30 is caused to rotate clockwise in the figure, while the developing roller 31 is caused to rotate counterclockwise in the figure.

A toner density sensor 33 is located in the stirring-transport chamber 21 so as to face the stirring-transport screw 25*a*, and a toner replenishing motor (not shown) for performing replenishment with the toner from the toner container 4*a* (see FIG. 1) at a predetermined speed is disposed in the vicinity of a toner replenishing port 20*c*. As illustrated in FIG. 3, the toner replenishing port 20*c* is located in an upstream side end portion of the stirring-transport chamber 21 in a circulating direction of the developer when viewed as a plane, and the toner density sensor 33 is located on a downstream side of the toner replenishing port 20*c* in the circulating direction of the developer.

Used as the toner density sensor 33 is a magnetic permeability sensor for detecting a magnetic permeability of a two-component developer including the toner and the magnetic carrier within the developing container 20. Here, a toner density represents a ratio (T/C) of the toner to the magnetic carrier within the developer, and in this embodiment, the toner density sensor 33 is configured to detect the magnetic permeability of the developer and output a voltage value corresponding to a detection result thereof to a control portion (not shown). Then, the toner density is decided from an output value obtained from the toner density sensor 33. The control portion transmits a control signal corresponding to the decided toner density to the toner replenishing motor, and replenishes the developing container 20 with a predetermined amount of toner through the toner replenishing port 20*c*.

A sensor output value changes in accordance with the toner density. As the toner density becomes higher, a ratio of the toner to the magnetic carrier becomes higher, and the toner that does not let magnetism pass therethrough increases in proportion, which lowers the output value. Meanwhile, as the toner density becomes lower, the ratio of the toner to the carrier becomes lower, and the carrier that lets magnetism pass therethrough increases in proportion, which raises the output value.

The magnetic roller 30 includes a non-magnetic rotation sleeve that rotates clockwise in FIG. 2 and a fixed magnetic body provided inside the rotation sleeve and having a plurality of magnetic poles.

The developing roller 31 includes a cylindrical-shaped developing sleeve that rotates counterclockwise in FIG. 2 and a developing roller side magnetic pole fixed to an inside of the developing sleeve. The magnetic roller 30 and the developing roller 31 are opposed to each other in a facing position (opposing position) with a predetermined gap. The developing roller side magnetic pole has an opposite polarity to the opposing magnetic pole (main pole) of the fixed magnetic body.

Further, an ear cutting blade 35 is attached to the developing container 20 along a longitudinal direction (front-to-back direction in terms of the paper of FIG. 2) of the magnetic roller 30, and the ear cutting blade 35 is positioned on an upstream side of the opposing position between the developing roller 31 and the magnetic roller 30 in a rotational direction (clockwise in the figure) of the magnetic roller 30. Further, a slight clearance (gap) is formed between a tip portion of the ear cutting blade 35 and a surface of the magnetic roller 30.

A direct current voltage (hereinafter, referred to as "Vslv (DC)") and an alternating current voltage (hereinafter, referred to as "Vslv (AC)") are applied to the developing roller 31, while a direct current voltage (hereinafter, referred to as "Vmag (DC)") and an alternating current voltage (hereinafter, referred to as "Vmag (AC)") are applied to the magnetic roller 30. Those direct current voltages and alternating current voltages are applied to the developing roller 31 and the magnetic roller 30 from a developing bias power source (not shown) through a bias control circuit (not shown).

As described above, while stirring the developer, the stirring-transport screw 25*a* and the supplying-transport screw 25*b* cause the developer to circulate in the stirring-transport chamber 21 and the supplying-transport chamber 22 within the developing container 20 so as to charge the toner, and the developer is transported to the magnetic roller 30 by the supplying-transport screw 25*b*. Then, the magnetic roller 30 has a magnetic brush (not shown) formed thereon, and the magnetic brush on the magnetic roller 30 has its layer thickness regulated by the ear cutting blade 35. After that, the magnetic brush is conveyed to an opposing part between the magnetic roller 30 and the developing roller 31, and a toner thin layer is formed on the developing roller 31 based on a potential difference ΔV between Vmag (DC) applied to the magnetic roller 30 and Vslv (DC) applied to the developing roller 31, and a magnetic field.

A toner layer thickness on the developing roller 31 also changes in accordance with a resistance of the developer, a difference in rotational speed between the magnetic roller 30 and the developing roller 31, and the like, but can be controlled based on the potential difference ΔV. A toner layer on the developing roller 31 becomes thicker with a larger potential difference ΔV and becomes thinner with a smaller potential difference ΔV. In general, an appropriate range of the potential difference ΔV at the time of the development is approximately 100 V to 350 V.

Figure 4A:
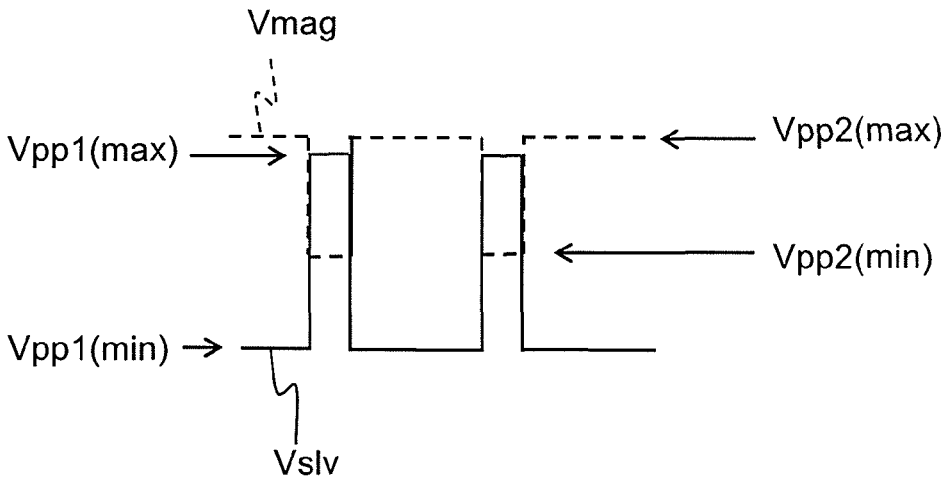
FIGS. 4A and 4B are diagrams illustrating examples of a bias waveform applied to a developing roller and a magnetic roller.
Figure 4B:
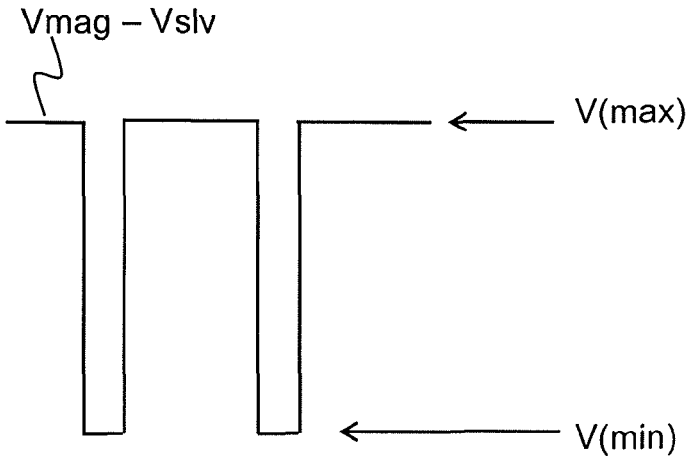

FIGS. 4A and 4B are diagrams illustrating examples of a bias waveform applied to the developing roller 31 and the magnetic roller 30. As illustrated in FIG. 4A, a combined waveform Vslv (solid line), which is obtained by superimposing a rectangular wave Vslv (AC) having a peak-to-peak value of Vpp1 on Vslv (DC), is applied to the developing roller 31. Further, a combined waveform Vmag (broken line), which is obtained by superimposing a rectangular wave Vmag (AC) having a peak-to-peak value of Vpp2 and having a different phase from Vslv (AC) on Vmag (DC), is applied to the magnetic roller 30.

Therefore, a voltage applied between the magnetic roller 30 and the developing roller 31 (hereinafter, referred to as "between MS") becomes a combined waveform Vmag-Vslv having Vpp (max) and Vpp (min) as illustrated in FIG. 4B. Note that, Vmag (AC) is set to have a larger duty factor than Vslv (AC). In actuality, an alternating current voltage having a partially distorted shape is applied unlike a perfect rectangular waveform as illustrated in FIG. 4B.

The toner thin layer formed on the developing roller 31 by the magnetic brush is transported by the rotation of the developing roller 31 to the opposing part between the photosensitive drum 1*a* and the developing roller 31. Vslv (DC) and Vslv (AC) are applied to the developing roller 31, and hence the toner flies due to a potential difference from the photosensitive drum 1*a*, and the electrostatic latent images on the photosensitive drum 1*a* are developed.

Figure 5:
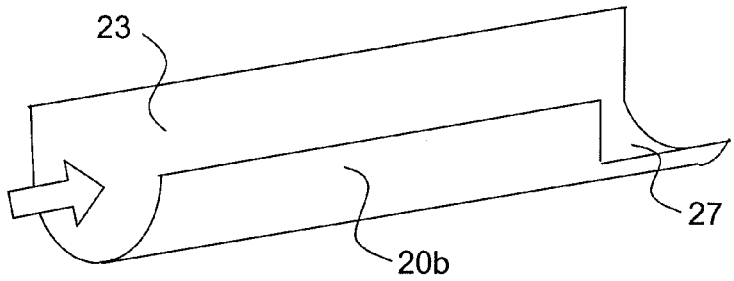
FIG. 5 is a schematic perspective view illustrating a collecting-transport chamber of the developing device according to the first embodiment.

The remaining toner that has not used for the development is again transported to the opposing part between the developing roller 31 and the magnetic roller 30, and is collected by the magnetic brush on the magnetic roller 30. After being scraped off from the magnetic roller 30 in a homopolar portion of a fixed magnetic body, the magnetic brush falls into the collecting-transport chamber 23. The developer within the collecting-transport chamber 23 is transported in the axial direction by the collecting-transport screw 25*c*, and is merged into the developer within the supplying-transport chamber 22 from the communication portion 27. As illustrated in FIG. 5, the communication portion 27 is formed by cutting out a downstream side end portion of the partition wall 20*b* in the circulating direction (indicated by the white arrow in the figure) of the developer.

After that, the developer is replenished with a predetermined amount of toner through the toner replenishing port 20*c* based on an output from the toner density sensor 33, and while circulating through the supplying-transport chamber 22 and the stirring-transport chamber 21, becomes the two-component developer uniformly charged with an optimal toner density again. The above-mentioned developer is again supplied onto the magnetic roller 30 by the supplying-transport screw 25*b*, to thereby form the magnetic brush, and is transported to the ear cutting blade 35.

As illustrated in FIG. 2, the collecting-transport chamber 23 is formed in higher position than the supplying-transport chamber 22. Therefore, the developer transported through within the collecting-transport chamber 23 by the collecting-transport screw 25*c* is merged into the developer within the supplying-transport chamber 22 while falling thereinto from the communication portion 27, which allows the developer to circulate smoothly.

When a transporting speed of the developer within the collecting-transport chamber 23 is slow, a developer amount within the supplying-transport chamber 22 is reduced, and a balance of the developer within the developing container 20 deteriorates and exerts an adverse influence on a developing ability. On the other hand, when a large amount of developer with the lowered toner density within the collecting-transport chamber 23 is collectively merged into the developer within the supplying-transport chamber 22, the developer is not sufficiently stirred before transported to the toner replenishing port 20*c*, and which causes unevenness in toner density within the developing container 20.

Therefore, in this embodiment, a diameter of a helical blade of the collecting-transport screw 25*c* located within the collecting-transport chamber 23 is set smaller than that of the supplying-transport screw 25*b* located within the supplying-transport chamber 22, while the number of revolutions per unit time (rotational speed) of the collecting-transport screw 25*c* is set larger than that of the supplying-transport screw 25*b*. Accordingly, the developer with the lowered toner density within the collecting-transport chamber 23 can be rapidly returned to an inside of the supplying-transport chamber 22 little by little, which allows the balance of the developer and the toner density within the developing container 20 to be maintained constant.

In this embodiment, the stirring-transport screw 25*a* and the supplying-transport screw 25*b* are set to have a shaft diameter being 8 mm, an outer diameter of the helical blade being 20 mm, a pitch thereof being 15 mm, and the number of revolutions per unit time being 450 rpm. Further, the collecting-transport screw 25*c* is set to have a shaft diameter being 5 mm, an outer diameter of the helical blade being 10 mm, a pitch thereof being 10 mm, and the number of revolutions per unit time being 500 rpm.

Further, as illustrated in FIG. 3, the communication portion 27 in which the developer is passed from the collecting-transport chamber 23 to the supplying-transport chamber 22 is provided on an upstream side of the second developer passage 26*b* in which the developer is passed from the supplying-transport chamber 22 to the stirring-transport chamber 21 in terms of a transporting direction of the developer (direction indicated by the arrow C). According to this structure, the developer with the lowered toner density within the collecting-transport chamber 23 is transported to the toner replenishing port 20*c* in a state of being sufficiently mixed with the developer within the supplying-transport chamber 22, and achieves an approximately uniform toner density within the developer before being replenished with new toner. Therefore, after the replenishment with the toner, the toner density within the developer can be stabilized before the developer is transported through the stirring-transport chamber 21 and again supplied from the supplying-transport chamber 22 to the magnetic roller 30.

Figure 6:
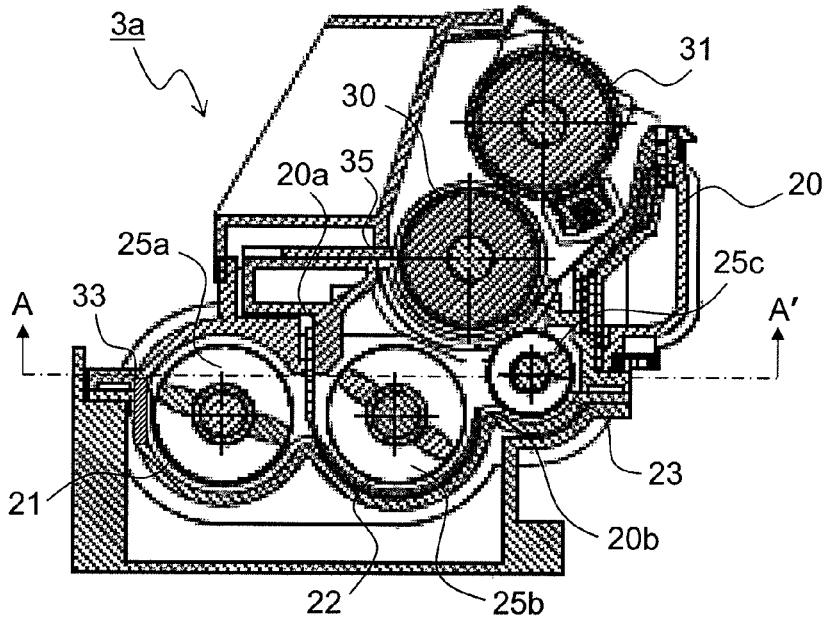
FIG. 6 is a sectional side view illustrating structure of a developing device according to a second embodiment of the present invention.
Figure 7:
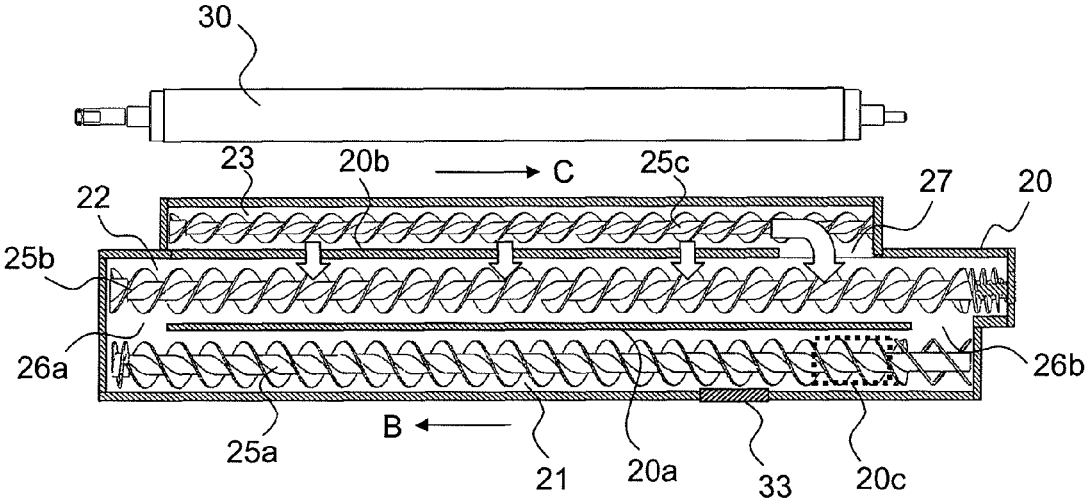
FIG. 7 is a sectional plan view illustrating structure of the developing device according to the second embodiment.
Figure 8:
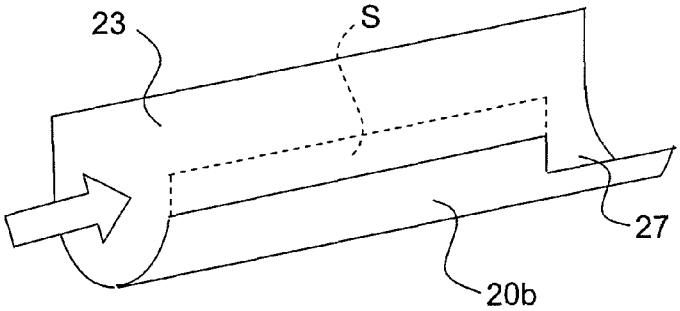
FIG. 8 is a schematic perspective view illustrating a collecting-transport chamber of the developing device according to the second embodiment.

FIG. 6 is a sectional side view of a developing device according to a second embodiment of the present invention, FIG. 7 is a sectional plan view (sectional view from the arrows AA' of FIG. 6) of the developing device according to the second embodiment, and FIG. 8 is a perspective view schematically illustrating a collecting-transport chamber of the developing device according to the second embodiment. The parts common to those of the first embodiment illustrated in FIG. 2 and FIG. 3 are denoted by the same reference symbols, and description thereof is omitted. Further, the shaft diameters, the outer diameters of the helical blade, the pitches thereof, and the numbers of revolutions per unit time of the stirring-transport screw 25*a*, of the supplying-transport screw 25*b*, and of the collecting-transport screw 25*c* are also completely the same as those of the first embodiment.

In this embodiment, the partition wall 20*b* having such an angular shape as to protrude from a bottom surface of the developing container 20 does not completely vertically partition the supplying-transport chamber 22 and the collecting-transport chamber 23, and as illustrated in FIG. 8, a clearance S is formed above the partition wall 20*b*. According to this structure, the developer within the collecting-transport chamber 23 is merged into the developer within the supplying-transport chamber 22 from the communication portion 27. At the same time, the developer within the collecting-transport chamber 23 climbs over the partition wall 20*b* from a wide-range region on an upstream side of the communication portion 27 in terms of the transporting direction of the developer (direction indicated by the arrow C), passes through the clearance S, and falls into the inside of the supplying-transport chamber 22.

Therefore, a distance by which the developer within the collecting-transport chamber 23 is transported after being merged into the developer within the supplying-transport chamber 22 up to the toner replenishing port 20*c* is longer than in the first embodiment in which the developer within the collecting-transport chamber 23 is merged into the developer within the supplying-transport chamber 22 only from the communication portion 27. As a result, the developer within the supplying-transport chamber 22 is replenished with the toner after being sufficiently stirred and made uniform, and hence it is possible to further stabilize the toner density within the developer.

Further, the developer is gradually returned to the supplying-transport chamber 22 from not only the communication portion 27 but also the wide-range region on the upstream side thereof, which facilitates the control of the developer amount within the supplying-transport chamber 22 and can improve stability of a developer balance.

Note that, as the range of the region through which the developer is returned from the collecting-transport chamber 23 to the supplying-transport chamber 22 becomes wider, the structure becomes more advantageous for the stabilization of the developer balance within the supplying-transport chamber 22 but exhibits a higher risk of causing the developer with the lowered toner density to be immediately carried on the magnetic roller 30 again. Hence, it is preferred that a width in the transporting direction of the region through which the developer is returned from the collecting-transport chamber 23 to the supplying-transport chamber 22 and a returning amount of the developer be adjusted based on a height and a shape of the partition wall 20*b* in consideration of the developer balance and influence on an image density.

Figure 9A:
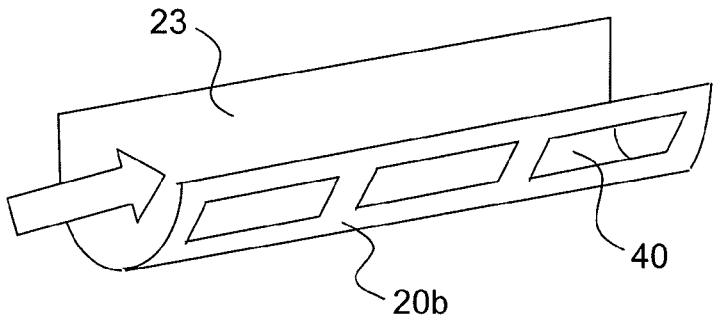
FIGS. 9A and 9B are perspective views schematically illustrating other structural examples of the collecting-transport chamber of the developing device according to the second embodiment.
Figure 9B:
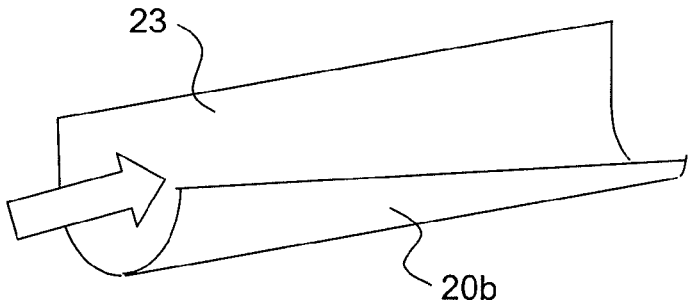

FIGS. 9A and 9B are perspective views schematically illustrating other structural examples of the collecting-transport chamber of the developing device according to the second embodiment. FIG. 9A illustrates structure in which a plurality of opening portions 40 are provided in the partition wall 20*b*, and FIG. 9B illustrates structure in which the partition wall 20*b* is gradually lowered from an upstream side in the transporting direction of the developer toward the downstream side.

The width of the region through which the developer is returned from the collecting-transport chamber 23 to the supplying-transport chamber 22 and the returning amount of the developer can be adjusted by changing the shape, size, number, and layout of the opening portions 40 provided in the partition wall 20*b* in the case of the structure of FIG. 9A and by changing the inclination of a top surface of the partition wall 20*b* in the case of the structure of FIG. 9B.

Next described is a developing device according to a third embodiment of the present invention. The developing device of this embodiment has completely the same structure as that of the second embodiment, but the transporting speeds of the supplying-transport screw 25*b* located in the supplying-transport chamber 22 and the collecting-transport screw 25*c* located in the collecting-transport chamber 23 are different from each other.

In the developing device of the above-mentioned second embodiment, in the case where the transporting speeds of the supplying-transport screw 25*b* located in the supplying-transport chamber 22 and the collecting-transport screw 25*c* located in the collecting-transport chamber 23 are the same, the developer that has been scraped off from the magnetic roller 30 and collected within the collecting-transport chamber 23 climbs over the partition wall 20*b* and falls into the developer within the supplying-transport chamber 22 in which the developer is transported at the same speed. Then, the collected developer that has fallen from the collecting-transport chamber 23 cannot be dispersed within the supplying-transport chamber 22, and a part with a low toner density is likely to occur within the developer within the supplying-transport chamber 22.

As a result, particularly in a case where an image having a high density in part such as a patch image is printed, the developer that has been used for the development and has the toner density lowered is directly supplied onto the magnetic roller 30, which causes a malfunction that the previous image appears as hysteresis.

Figure 10:
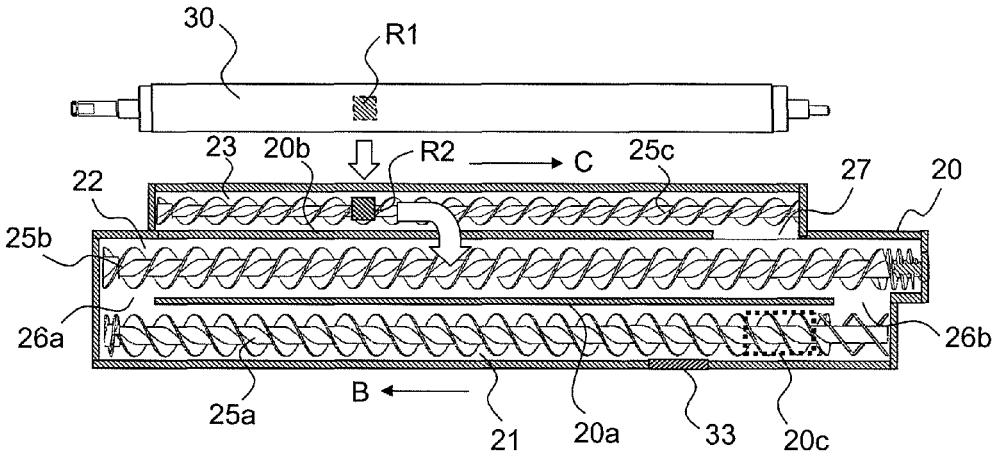
FIG. 10 is a sectional plan view illustrating a flow of a developer from a collecting-transport chamber of a developing device according to a third embodiment of the present invention to a supplying-transport chamber thereof.

Therefore, in this embodiment, as illustrated in FIG. 10, the transporting speed of the collecting-transport screw 25*c* located in the collecting-transport chamber 23 is set slower than the supplying-transport screw 25*b* located in the supplying-transport chamber 22. In this case, the developer that has been scraped off from a region R1 of the surface of the magnetic roller 30 and has fallen to a region R2 within the collecting-transport chamber 23 is dispersed on a downstream side in the transporting direction of the region R2 by the supplying-transport screw 25*b* exhibiting a faster speed than the collecting-transport screw 25*c* when climbing over the partition wall 20*b* and falling into the supplying-transport chamber 22.

Figure 11:
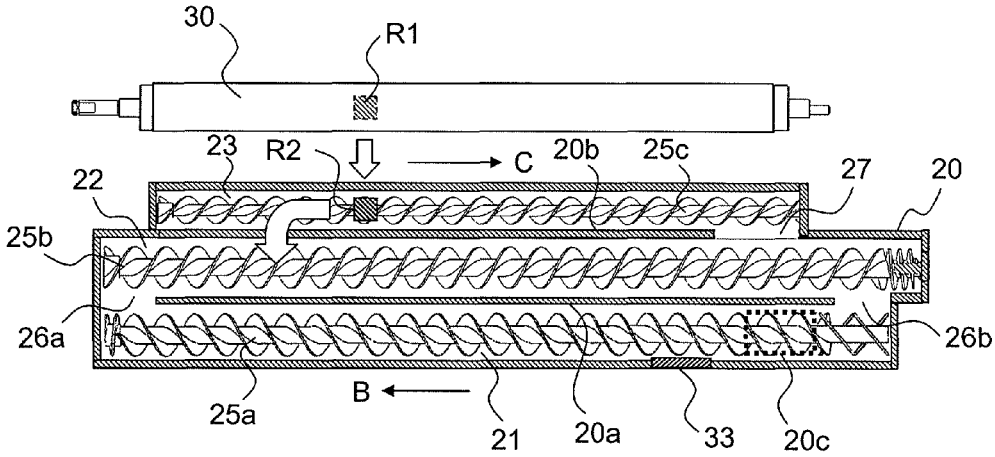
FIG. 11 is a sectional plan view illustrating a flow of a developer from a collecting-transport chamber of another structure of the developing device according to the third embodiment to the supplying-transport chamber thereof.

Alternatively, as illustrated in FIG. 11, the transporting speed of the collecting-transport screw 25*c* may be set faster than that of the supplying-transport screw 25*b*. In this case, the developer that has been scraped off from the region R1 of the surface of the magnetic roller 30 and has fallen to the region R2 within the collecting-transport chamber 23 is dispersed on an upstream side in the transporting direction of the region R2 by the supplying-transport screw 25*b* exhibiting a slower speed than the collecting-transport screw 25*c* when climbing over the partition wall 20*b* and falling into the supplying-transport chamber 22.

In other words, by setting the supplying-transport chamber 22 and the collecting-transport chamber 23 to have different transporting speeds (moving speeds) of the developer, the developer that has been collected from the surface of the magnetic roller 30 and has the toner density lowered is returned to the inside of the supplying-transport chamber 22 in a state of being dispersed along the transporting direction. Therefore, it is possible to suppress an occurrence of such development hysteresis as described above.

Note that, as illustrated in FIG. 10, in the case where the transporting speed of the collecting-transport screw 25*c* is set slower than that of the supplying-transport screw 25*b*, the developer with the lowered toner density is not collectively transported to the communication portion 27, and hence an effect of toner dispersion can be expected not only on an upstream side of the communication portion 27 but also in the communication portion 27. As a result, the structure of FIG. 10 is more preferred than that of FIG. 11 because it is easy to suppress the unevenness in toner density and the occurrence of the development hysteresis.

Further, the method of setting the supplying-transport chamber 22 and the collecting-transport chamber 23 to have different transporting speeds of the developer is not particularly limited, and various methods can be used such as a method of changing the pitch of the helical blade in addition to the method of changing the rotational speeds of the supplying-transport screw 25*b* and the collecting-transport screw 25*c*.

For example, in the case where the transporting speed of the collecting-transport screw 25*c* is set slower as in FIG. 10, in this embodiment, as an example of structure and a drive condition of a stirring screw, the stirring-transport screw 25*a* and the supplying-transport screw 25*b* are set to have the shaft diameter being 8 mm, the outer diameter of the helical blade being 20 mm, the pitch thereof being 15 mm, and the number of revolutions per unit time being 500 rpm, while the collecting-transport screw 25*c* is set to have the shaft diameter being 4 mm, the outer diameter of the helical blade being 8 mm, the pitch thereof being 10 mm, and the number of revolutions per unit time being 510 rpm.

Figure 12:
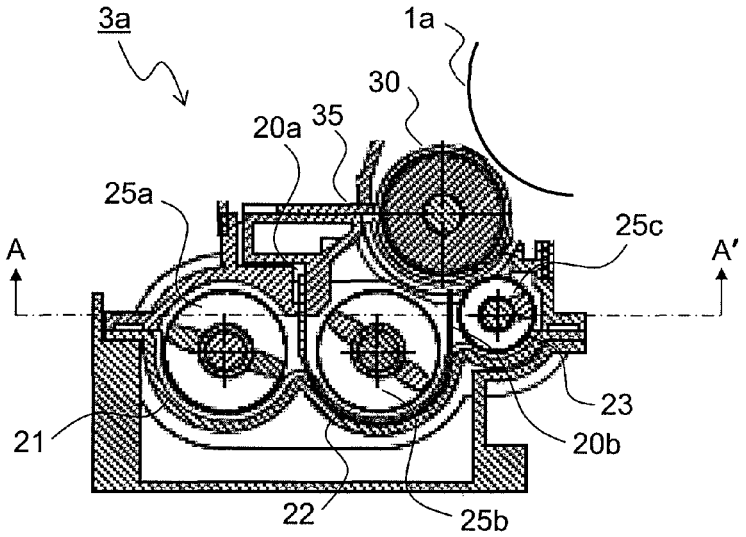
FIG. 12 is a sectional side view illustrating another structural example of the developing device according to the third embodiment.
Figure 13:
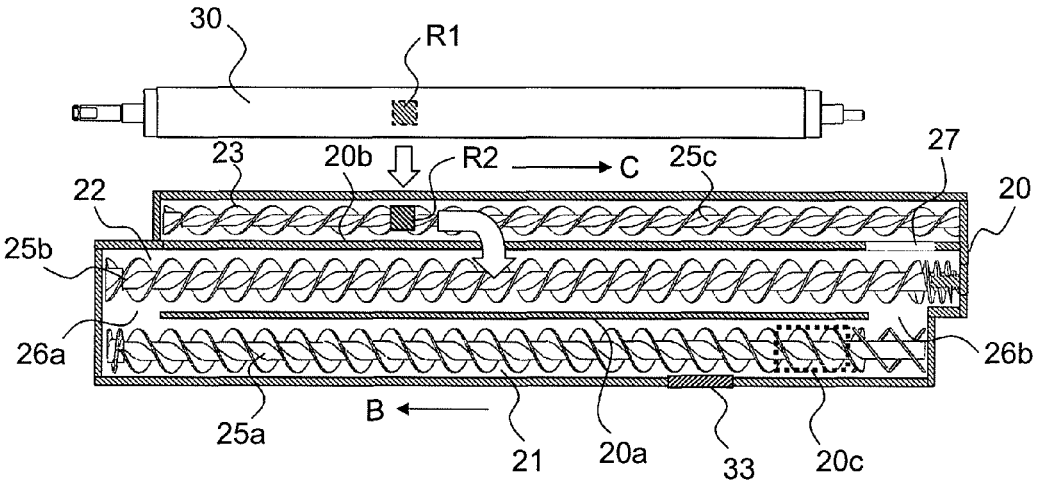
FIG. 13 is a sectional plan view illustrating another structural example of the developing device according to the third embodiment.

FIG. 12 is a sectional side view illustrating another structural example of the developing device according to the third embodiment of the present invention, and FIG. 13 is a sectional plan view (sectional view from the arrows AA' of FIG. 12) illustrating another structural example of the developing device. In FIG. 12, the transporting speed of the collecting-transport screw 25*c* is set slower than that of the supplying-transport screw 25*b* in the developing device of a two-component development method which is not provided with the developing roller 31 on which the toner thin layer is formed and performs the development by bringing the magnetic brush formed on the magnetic roller 30 into direct contact with the photosensitive drum 1*a*.

Further, as illustrated in FIG. 13, the communication portion 27 is provided in substantially the same position as the second developer passage 26*b* in terms of the transporting direction of the developer (direction indicated by the arrow C).

Also in the developing device 3*a* illustrated in FIG. 12 and FIG. 13, the developer that has been scraped off from the region R1 of the surface of the magnetic roller 30 and has fallen to the region R2 within the collecting-transport chamber 23 is dispersed on the downstream side in the transporting direction of the region R2 by the supplying-transport screw 25*b* exhibiting a faster speed than the collecting-transport screw 25*c* when climbing over the partition wall 20*b* and falling into the supplying-transport chamber 22. Therefore, the same action and effect as those of the developing device 3*a* illustrated in FIG. 10 are obtained. Alternatively, the transporting speed of the collecting-transport screw 25*c* may be set faster than that of the supplying-transport screw 25*b*. In that case, it is natural that the same effect as that of the developing device 3*a* illustrated in FIG. 11 be obtained.

Figure 14:
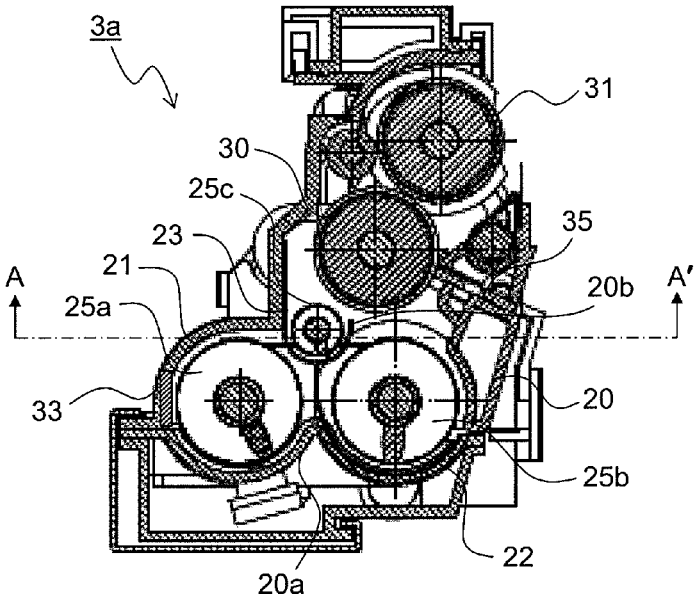
FIG. 14 is a sectional side view illustrating structure of a developing device according to a fourth embodiment of the present invention.
Figure 15:
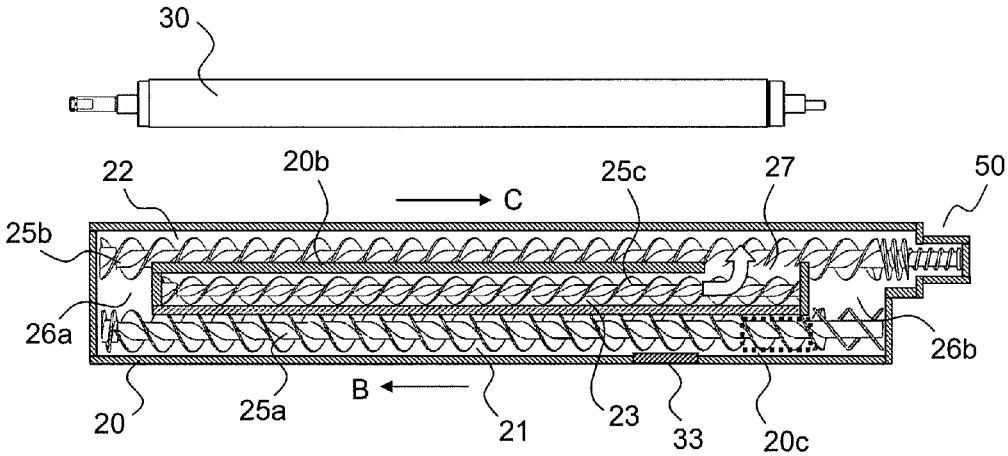
FIG. 15 is a sectional plan view illustrating structure of the developing device according to the fourth embodiment.

FIG. 14 is a sectional side view of a developing device according to a fourth embodiment of the present invention, and FIG. 15 is a sectional plan view (sectional view from the arrows AA' of FIG. 14) of the developing device according to the fourth embodiment. In this embodiment, unlike each of the above-mentioned embodiments, the magnetic roller 30 and the developing roller 31 are structured to rotate counterclockwise and clockwise, respectively, in FIG. 14. Hence, the developer that has been scraped off from the magnetic roller 30 falls to the inside of the supplying-transport chamber 22. Therefore, the collecting-transport chamber 23 is provided above the supplying-transport chamber 22 and the stirring-transport chamber 21 in the vicinity of a boundary therebetween.

Further, the developing device according to this embodiment is structured so that replenishment with a new carrier is performed together with the toner, while a surplus developer including the degraded carrier is discharged. That is, the developing container 20 is replenished with the toner and the new carrier from the toner containers 4*a* to 4*d* (see FIG. 1) and a carrier container (not shown) via the toner replenishing port 20*c*. Further, a developer discharge portion 50 for discharging the surplus developer (corresponding to the developer amount supplied by the replenishment through the toner replenishing port 20*c*) is provided at a downstream end of the supplying-transport chamber 22 in terms of the transporting direction of the developer. Structures of the other parts are the same as those of the first embodiment, and description thereof is omitted.

According to this method, the new carrier is supplied together with the toner, while the degraded carrier is gradually discharged as the surplus developer from the developer discharge portion 50. As a result, the degraded carrier within the developing container 20 can be replaced by a new carrier, which can achieve a longer life of the developing device 3*a*.

Also in the fourth embodiment, the collecting-transport chamber 23 is provided in a higher position than the supplying-transport chamber 22, and hence the developer that has been transported through within the collecting-transport chamber 23 is merged into the developer within the supplying-transport chamber 22 while falling thereinto from the communication portion 27, which allows the developer to circulate smoothly. Further, the communication portion 27 is provided on the upstream side of the second developer passage 26*b* in terms of the transporting direction of the developer (direction indicated by the arrow C). Accordingly, the developer with the lowered toner density within the collecting-transport chamber 23 is transported to the toner replenishing port 20*c* in the state of being sufficiently mixed with the developer within the supplying-transport chamber 22, and can achieve the approximately uniform toner density within the developer before being replenished with the new toner and the carrier.

In addition, by combination with the structure of the second embodiment in which the developer is gradually returned to the supplying-transport chamber 22 from not only the communication portion 27 but also the wide-range region on the upstream side thereof, it is possible to suppress an imbalance of the developer within the developing container 20. Therefore, it is possible to prevent an occurrence of density unevenness and to maintain a discharge amount from the developer discharge portion 50 at a constant level. In addition, by combination with the structure of the third embodiment in which the supplying-transport chamber 22 and the collecting-transport chamber 23 are set to have different transporting speeds of the developer, it is possible to suppress the occurrence of the development hysteresis.

Figure 16:
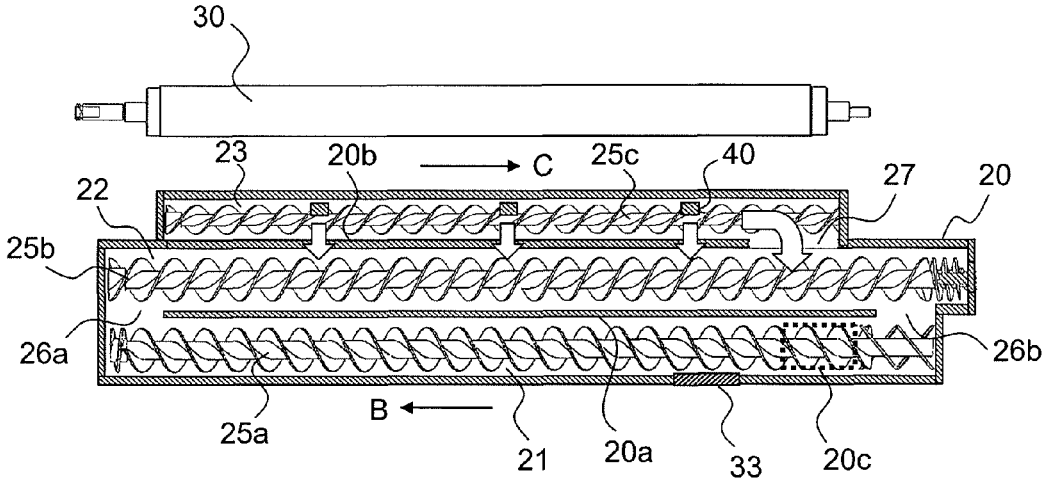
FIG. 16 is a sectional plan view illustrating structure of a developing device according to a fifth embodiment of the present invention.

FIG. 16 is a sectional plan view of a developing device according to a fifth embodiment of the present invention. The developing device 3*a* basically has the same structure as that of the second embodiment illustrated in FIG. 6 to FIG. 8, and hence description thereof is omitted. In this embodiment, ribs 40 substantially parallel with a rotary shaft are provided at three points of the rotary shaft of the collecting-transport screw 25*c* between surfaces of the helical blade.

According to the above-mentioned structure, in a part provided with the rib 40, a force in the transporting direction of the developer (direction indicated by the arrow C) is not applied to the developer within the collecting-transport chamber 23, and the developer builds up and increases in volume. That is, the part provided with the rib 40 functions as a deceleration portion exhibiting a slower transporting speed than the other parts. In addition, a force in a direction perpendicular to the transporting direction is applied to the built-up developer by the rotation of the ribs 40. Therefore, as indicated by the white arrows in the figure, the developer transported through the collecting-transport chamber 23 is merged into the developer within the supplying-transport chamber 22 from the communication portion 27, while parts of the developer climb over the partition wall 20*b* from the three points (points in which the ribs 40 are formed) on the upstream side of the communication portion 27 in terms of the transporting direction (direction indicated by the arrow C), pass through the clearance S, and fall into the inside of the supplying-transport chamber 22.

Therefore, a distance by which the developer within the collecting-transport chamber 23 is transported after being merged into the developer within the supplying-transport chamber 22 up to the toner replenishing port 20*c* becomes long. As a result, the developer within the supplying-transport chamber 22 is replenished with the toner after being sufficiently stirred and made uniform, and hence it is possible to further stabilize the toner density within the developer.

Further, the developer is gradually returned to the supplying-transport chamber 22 from not only the communication portion 27 but also the wide-range region on the upstream side thereof, which facilitates the control of the developer amount within the supplying-transport chamber 22 and can improve stability of a developer balance.

Incidentally, when the developer that has been scraped off from the magnetic roller 30 and collected within the collecting-transport chamber 23 is collectively returned into the developer within the supplying-transport chamber 22, the part with the low toner density is likely to occur within the developer within the supplying-transport chamber 22. As a result, particularly in the case where an image having a high density in part such as a patch image is printed, the developer that has been used for the development and has the toner density lowered is directly supplied onto the magnetic roller 30, which causes a malfunction that the previous image appears as hysteresis.

According to the structure of this embodiment, the developer that has been collected from the surface of the magnetic roller 30 and has the toner density lowered temporarily builds up in vicinities of the ribs 40, climbs over the partition wall 20*b* little by little, and is returned to the inside of the supplying-transport chamber 22. Therefore, it is also possible to suppress the occurrence of such development hysteresis as described above.

Note that, as the range of the region through which the developer is returned from the collecting-transport chamber 23 to the supplying-transport chamber 22 becomes wider, the structure becomes more advantageous for the stabilization of the developer balance within the supplying-transport chamber 22 but exhibits a higher risk of causing the developer with the lowered toner density to be immediately carried on the magnetic roller 30 again. Hence, it is preferred that a width in the transporting direction of the region through which the developer is returned from the collecting-transport chamber 23 to the supplying-transport chamber 22 and a returning amount of the developer be adjusted based on a height of the partition wall 20*b* or the size, shape, and number of the ribs 40 in consideration of the developer balance and influence on an image density.

Further, in the structure of the above-mentioned embodiment, the clearance S is provided above the partition wall 20*b*, and the developer that has built up in the vicinities of the ribs 40 climbs over the partition wall 20*b* and is returned to the inside of the supplying-transport chamber 22, but the present invention is not limited thereto. For example, as illustrated in FIG. 9A, one or more opening portions may be provided in the partition wall 20*b*.

Figure 17:
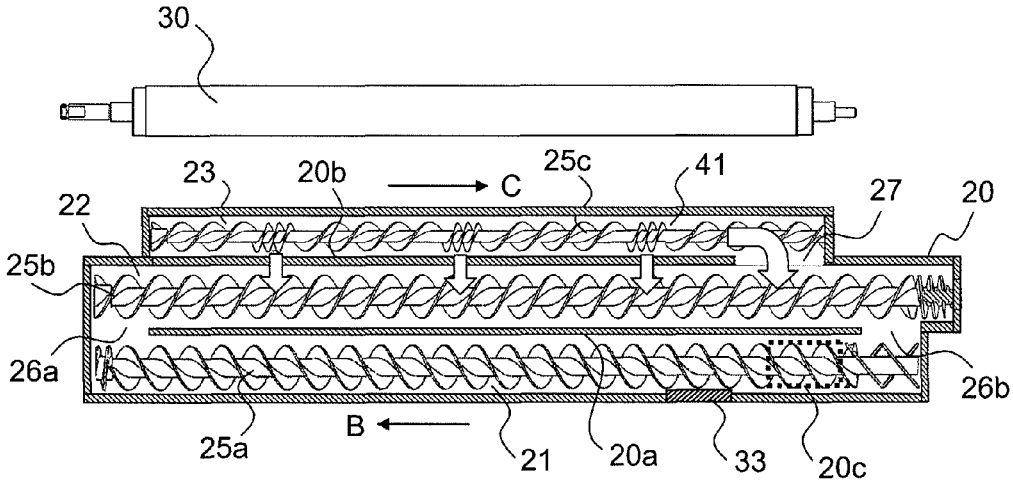
FIG. 17 is a sectional plan view illustrating structure of a developing device according to a sixth embodiment of the present invention.

FIG. 17 is a sectional plan view of a developing device according to a sixth embodiment of the present invention. The developing device basically has the same structure as that of the second embodiment illustrated in FIG. 6 to FIG. 8, and hence description thereof is omitted. In this embodiment, narrow pitch portions 41 having a narrower pitch of the helical blade than the other parts are provided at the three points of the collecting-transport screw 25*c* as the deceleration portions in place of the ribs 40.

According to the above-mentioned structure, a transport force applied to the developer in the narrow pitch portions 41 is smaller than a transport force in the other parts of the collecting-transport screw 25*c*, and hence the building up of the developer occurs in the narrow pitch portions 41, thereby increasing the developer in volume. As a result, as indicated by the white arrows in the figure, the developer transported through the collecting-transport chamber 23 is merged into the developer within the supplying-transport chamber 22 from the communication portion 27, and at the same time, climbs over the partition wall 20*b* from the three points (points in which the narrow pitch portions 41 are formed) on the upstream side of the communication portion 27 in terms of the transporting direction of the developer (direction indicated by the arrow C), passes through the clearance S, and falls into the inside of the supplying-transport chamber 22.

Therefore, in the same manner as in the fifth embodiment, it is possible to further stabilize the toner density within the developer. Further, the control of the developer amount within the supplying-transport chamber 22 is facilitated, and the stability of the developer balance can be improved. In addition, the developer within the collecting-transport chamber 23 temporarily builds up in the vicinities of the narrow pitch portions 41 and is then returned to the inside of the supplying-transport chamber 22 little by little, and hence it is also possible to suppress the occurrence of the development hysteresis. Also in this embodiment, by changing the height of the partition wall 20*b*, the number of the narrow pitch portions 41 provided, a pitch widths of the respective narrow pitch portions 41, and the like, it is possible to adjust the width of the region through which the developer is returned from the collecting-transport chamber 23 to the supplying-transport chamber 22 and the returning amount of the developer.

Note that, here, the narrow pitch portions 41 are provided to cause the building up of the developer, but the building up of the developer can also be caused by providing a small diameter portion in which the diameter of the helical blade is partially reduced instead of providing the narrow pitch portions 41. Alternatively, both the pitch and the diameter of the helical blade may be partially reduced.

In the same manner as in the fourth embodiment illustrated in FIG. 14 and FIG. 15, the above-mentioned fifth and sixth embodiments may employ the structure of the developing device of a two-component development method which is not provided with the developing roller 31 on which the toner thin layer is formed and performs the development by bringing the magnetic brush formed on the magnetic roller 30 into direct contact with the photosensitive drum 1*a*. Also in this case, the same action and effect as those of the developing device 3*a* of the fourth embodiment are obtained.

Figure 18:
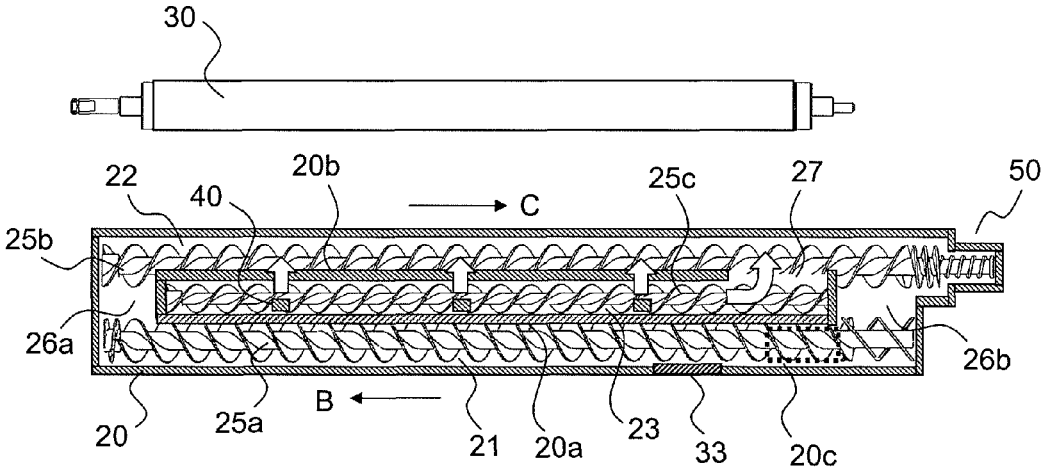
FIG. 18 is a sectional plan view illustrating structure of a developing device according to a seventh embodiment of the present invention.

FIG. 18 is a sectional plan view of a developing device according to a seventh embodiment of the present invention. In the same manner as the fourth embodiment, this embodiment has structure in which the magnetic roller 30 is caused to rotate counterclockwise in FIG. 18, while the developing roller 31 is caused to rotate clockwise in FIG. 18. Hence, the developer that has scraped off from the magnetic roller 30 falls to the inside of the supplying-transport chamber 22. Therefore, the collecting-transport chamber 23 is provided above the supplying-transport chamber 22 and the stirring-transport chamber 21 in the vicinity of the boundary therebetween.

Further, in the same manner as in the fourth embodiment, the developing device according to this embodiment is structured to have a method in which the replenishment with the new carrier is performed together with the toner, while the surplus developer including the degraded carrier is discharged. That is, the developing container 20 is replenished with the toner and the new carrier from the toner containers 4*a* to 4*d* (see FIG. 1) and the carrier container (not shown) via the toner replenishing port 20*c*. Further, the developer discharge portion 50 for discharging the surplus developer (corresponding to the developer amount supplied by the replenishment through the toner replenishing port 20*c*) is provided at the downstream end of the supplying-transport chamber 22 in terms of the transporting direction of the developer.

Also in the seventh embodiment, the collecting-transport chamber 23 is provided in a higher position than the supplying-transport chamber 22, and hence the developer that has been transported through within the collecting-transport chamber 23 is merged into the developer within the supplying-transport chamber 22 while falling thereinto from the communication portion 27, which allows the developer to circulate smoothly. Further, the communication portion 27 is provided on the upstream side of the second developer passage 26*b* in terms of the transporting direction of the developer (direction indicated by the arrow C). Accordingly, the developer with the lowered toner density within the collecting-transport chamber 23 is transported to the toner replenishing port 20*c* in the state of being sufficiently mixed with the developer within the supplying-transport chamber 22, and can achieve the approximately uniform toner density within the developer before being replenished with the new toner and the carrier.

In addition, in the same manner as in the fifth embodiment, the collecting-transport screw 25*c* is provided with the ribs 40, and hence the developer can be gradually returned to the supplying-transport chamber 22 from not only the communication portion 27 but also the wide-range region on the upstream side thereof, which can suppress the imbalance of the developer within the developing container 20. Therefore, it is possible to prevent the occurrence of the density unevenness and to maintain the discharge amount from the developer discharge portion 50 at a constant level. Further, the same effect is naturally obtained also by the structure that causes the developer to build up by providing the narrow pitch portions 41 in place of the ribs 40 as in the sixth embodiment.

In addition, the present invention is not limited to the above-mentioned respective embodiments, and various changes can be made within the scope that does not depart from the gist of the present invention. For example, the present invention is not limited to the developing device including the magnetic roller 30 and the developing roller 31 as illustrated in the above-mentioned respective embodiments, and can be applied to various developing devices using the two-component developer made of a toner component and a magnetic carrier.

Further, the present invention is not limited to the tandem color printer illustrated in FIG. 1, and can be applied to various image forming apparatuses such as a monochrome copier that have a digital or analog method, a monochrome printer, a color copier, a facsimile machine.

The embodiments of the present invention can be used for the developing device of the three-axis transport type which uses the two-component developer. By use of the present invention, it is possible to provide the developing device which allows the developer within the developing container to circulate smoothly and can effectively suppress the unevenness in toner density and toner charge amount and the occurrence of the development hysteresis. Further, by mounting the developing device according to the present invention, it is possible to provide the image forming apparatus for forming a high quality image that does not cause an image defect such as image density unevenness or development hysteresis.

What is claimed is:

1. A developing device, comprising:

a developing container partitioned into a stirring-transport chamber, a supplying-transport chamber, and a collecting-transport chamber that are arranged substantially in parallel with one another, for storing a two-component developer including a carrier and toner;

a developer carrying member supported rotatably by the developing container, for carrying the developer on a surface thereof;

a supplying-transport member located within the supplying-transport chamber, for stirring and transporting the developer along an axial direction of the developer carrying member and supplying the developer to the developer carrying member;

a stirring-transport member located within the stirring-transport chamber, for stirring and transporting the developer in a reverse direction to the supplying-transport member;

a collecting-transport member located within the collecting-transport chamber, for stirring and transporting the developer collected from the developer carrying member in the same direction as the supplying-transport member, the collecting-transport member having a developer transporting speed different from a developer transporting speed of the supplying-transport member;

a first developer passage provided between the supplying-transport chamber and the stirring-transport chamber, for passing the developer from the stirring-transport chamber to the supplying-transport chamber;

a second developer passage provided between the supplying-transport chamber and the stirring-transport chamber, for passing the developer from the supplying-transport chamber to the stirring-transport chamber; and a communication portion provided at a downstream end of the collecting-transport chamber in terms of a developer transporting direction, for passing the developer from the collecting-transport chamber to the supplying-transport chamber, wherein the collecting-transport member passes the developer to the supplying-transport chamber also from a region on an upstream side of the communication portion in terms of the developer transporting direction.

2. The developing device according to claim 1, wherein the developer transporting speed of the collecting-transport member is larger than the developer transporting speed of the supplying-transport member.

3. The developing device according to claim 2, wherein the collecting-transport member and the supplying-transport member each comprise a rotary shaft and a helical blade formed on an outer peripheral surface of the rotary shaft, the helical blade of the collecting-transport member having an outer diameter smaller than an outer diameter of the helical blade of the supplying-transport member, the collecting-transport member exhibiting a rotational speed faster than the supplying-transport member.

4. The developing device according to claim 1, wherein the communication portion is provided on an upstream side of the second developer passage in terms of the developer transporting direction.

5. The developing device according to claim 1, wherein the developer transporting speed of the collecting-transport member is smaller than the developer transporting speed of the supplying-transport member.

6. The developing device according to claim 5, wherein the developing container comprises a clearance provided along a longitudinal direction of the collecting-transport member above a partition wall that partitions the developing container into the collecting-transport chamber and the supplying-transport chamber.

7. The developing device according to claim 6, wherein the collecting-transport member comprises a deceleration portion exhibiting a slower transporting speed than other parts at at least one point on the upstream side of the communication portion in terms of the developer transporting direction.

8. The developing device according to claim 7, wherein the collecting-transport member comprises a rotary shaft and a helical blade formed on an outer peripheral surface of the rotary shaft; and the deceleration portion includes a rib formed between surfaces of the helical blade so as to protrude substantially in parallel with the rotary shaft.

9. The developing device according to claim 7, wherein the collecting-transport member comprises a rotary shaft and a helical blade formed on an outer peripheral surface of the rotary shaft; and the deceleration portion is partially small in at least one of a pitch and an outer diameter of the helical blade.

10. The developing device according to claim 1, wherein the collecting-transport chamber is located in a higher position than the supplying-transport chamber.

11. The developing device according to claim 1, further comprising a developer discharge portion provided at the downstream end of the supplying-transport chamber in terms of the developer transporting direction, for discharging a surplus developer.

12. An image forming apparatus comprising the developing device according to claim 1.

* * * * *